United States Patent [19]

Hyland

[11] 4,356,872

[45] Nov. 2, 1982

[54] DOWNHOLE CORE BARREL FLUSHING SYSTEM

[75] Inventor: Craig R. Hyland, Magna, Utah

[73] Assignee: Christensen, Inc., Salt Lake City, Utah

[21] Appl. No.: 179,587

[22] Filed: Aug. 21, 1980

[51] Int. Cl.[3] ..... E21B 25/08

[52] U.S. Cl. ..... 175/58; 175/239; 175/226; 175/233

[58] Field of Search ..... 175/233, 226, 58, 308, 175/59, 239, 240; 166/63, 162

[56] References Cited

U.S. PATENT DOCUMENTS

| | | | |
|---|---|---|---|
| 2,238,609 | 4/1941 | Sewell | 175/223 |
| 2,287,909 | 6/1942 | Sewell | 175/223 |
| 2,381,845 | 8/1945 | Stokes | 175/223 |
| 2,412,915 | 12/1946 | Sewell | 175/223 |
| 2,445,494 | 7/1948 | Redmond | 175/233 |
| 2,734,719 | 2/1956 | Otuay | 175/233 |
| 3,064,742 | 11/1962 | Bridwell | 175/233 |
| 3,174,547 | 3/1965 | Fields | 166/63 |
| 3,548,958 | 12/1970 | Blackwell | 175/233 |

*Primary Examiner*—Ernest R. Purser

*Assistant Examiner*—Thuy Bui

*Attorney, Agent, or Firm*—Walter Fred

[57] ABSTRACT

A core barrel flushing device and method is disclosed particularly for flushing drilling fluid, mud and other undesirable material from a pressure core barrel downhole at existing conditions and pressure.

The flushing device (F) comprises an outer barrel attachable to the drill string and core barrel (10), and an inner barrel (90) within the outer barrel (70). A sealed chamber (C) within the outer barrel (70) contains a piston (114) and flushing medium (M) displacable from the chamber (C) and into the core barrel during forceful displacement of the piston following actuation of the flushing device.

Actuation of the flushing device is initiated by means (B) passed down the drill string into engagement with actuating means (94) allowing displacement of the piston and flushing medium from the chamber into the core barrel.

Tripping means (112) are also disclosed responsive to the final movement of the piston to actuate, and seal the flushed pressure core barrel (10) and core sample (51) therein downhole.

15 Claims, 6 Drawing Figures

DOWNHOLE CORE BARREL FLUSHING SYSTEM

TECHNICAL DISCLOSURE

The invention relates to flushing core barrels and particularly to a method and apparatus for flushing drilling fluid or mud from a pressure core barrel situated downhole prior to sealing the pressure core barrel and core sample therein at the existing pressure of formation and raising to the surface for freezing, disassembly, and analysis.

BACKGROUND ART

A number of pressure core barrels adapted to take and seal core samples therein to the surface for disconnection and attachment to flushing apparatus prior to freezing removal and analysis of the core sample are disclosed in U.S. Pat. Nos. 2,238,609; 2,287,909; 2,381,845; 2,412,915; 2,445,494; 2,734,719; and 3,548,958.

Another improved pressure core barrel of the type disclosed in U.S. Pat. No. 3,548,958 and an improved above hole flushing system therefor is disclosed in a pending application Ser. No. 99670 now U.S. Patent No. 4,272,987 assigned to the assignee of record in the instant invention.

However, the applicant is unaware of any prior art methods or apparatus for flushing a core barrel situated downhole at existing downhole conditions and pressure prior to sealing the core sample taken therein and its removal to the surface for disconnection, freezing, removal and analysis.

The applicant's invention is unique in that it allows the flushing and displacement of drilling fluid and mud from any core barrel and particularly a pressure core barrel to be accomplished in situ or at bottom hole conditions. This also precludes the loss of bottom hole pressure from the core sample currently encountered when the flushing operation is carried out at the surface.

Further advantages are that the viscous flushing medium will enhance removal of solids from the pressure core barrel and thereby increase the reliability and more successful sealing valve closure thereof.

Less handling is required at the surface which reduces the possibility of pressure loss and the time between core sample recovery and the forwarding thereof for analysis.

DISCLOSURE OF THE INVENTION

A core barrel flushing method and device insertable in a drill string for attachment to an end of a core barrel assembly particularly of the type disclosed in U.S. Pat. No. 3,548,958 and preferably the improved version thereof disclosed in pending U.S. Application Ser. No. 055,471 filed July 6, 1979 now respectively U.S. Pat. Nos. 4,256,192 and 4,272,987 and Ser. No. 99,670 filed Dec. 3, 1979 incorporated herein by reference for details not disclosed hereinafter.

The flushing device comprises an outer barrel assembly with axially spaced sealing surfaces engaged by seals of an axially displaceable inner barrel assembly attached to the outer barrel assembly with shear pins. The inner barrel assembly has passages for circulating drilling fluid to and through the core barrel, an outer tube slideable on and initially held in a contracted position on the inner tube by shear pins.

A chamber between the inner tube and a section of the outer barrel assembly contains a flushing medium displaced therefrom by a piston axially movable therein by the pressure of the drilling fluid. Once the core sample has been taken, the core barrel assembly is lifted a sufficient distance above the bottom of the hole to allow operation thereof. Then a ball is dropped and seats against the end of the inner barrel assembly to stop flow of drilling fluid therethrough. Pressure builds up sufficiently to shear pins allowing the inner barrel assembly to move downwardly against a stop, disengages the seals and opens a passage for the drilling fluid pressure to act against the annular piston and a passage through which the flushing medium displaced thereby can flow and displace drilling fluid from the open core barrel. At a predetermined distance from the lower end of the chamber the annular piston engages the annular end surface of the outer tube which shears pins and moves downwardly under the force of the piston, relative to the fixed inner tube.

Movement of the piston continues to displace the flushing medium, the outer tube and a core barrel trip plug at the lower end thereof into sealing engagement with a core barrel actuating cylinder until the piston bottoms and exposes passages through which the drilling fluid above the piston passes into the inner and outer tubes displaced thereby to actuate the core barrel actuating cylinder.

Actuation of the cylinder releases dogs allowing outer core barrel to descend and actuate the sealing valve and seal off the core sample within the flushed core barrel assembly at the existing downhole pressure of formation and conditions.

BEST MODE OF CARRYING OUT THE INVENTION

Figure 1:
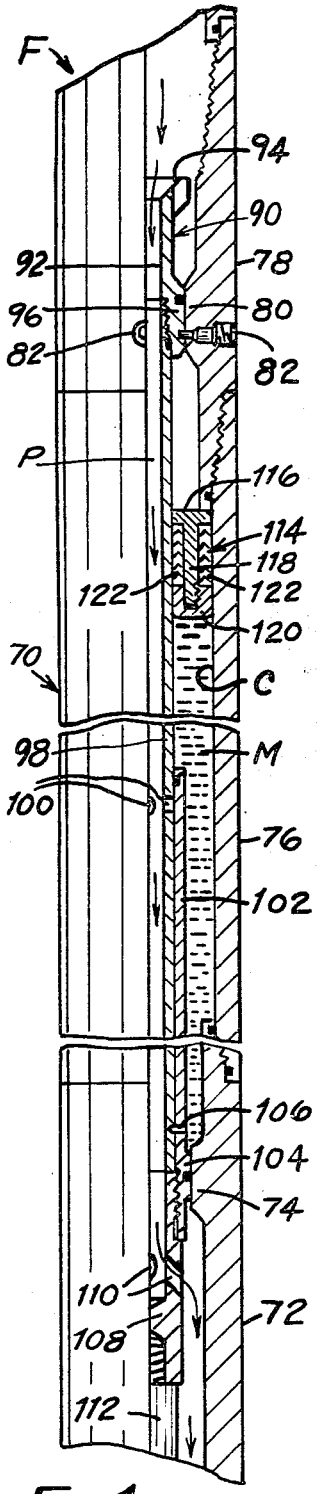
FIGS. 1 and 1A combined provide a partial cross sectional view showing the flushing apparatus and an upper portion of a core barrel assembly connected thereto in an initial, precoring or coring mode.

Referring to the drawings there is shown a portion of a drill string comprising a pressure core barrel assembly 10 of the type disclosed in the above identified U.S. Patent No. 3,548,958 and pending applications Ser. No. 055,471 and 99,670 now respectively U.S. Pat. Nos. 4,256,192 and 4,272,987 incorporated by reference and a downhole flushing apparatus or system F attached thereto.

For purposes of correlating the same reference characters used in the above identified pending applications are used herein to identify the corresponding component of the core barrel assembly 10.

Briefly, pressure core barrel assembly 10 comprises an outer barrel assembly 11 comprising a number of sections connected together and a core drill or bit CB at the lower end thereof. The outer barrel assembly 11 is interconnected to an inner core barrel assembly 12 by a splined slip joint assembly 13 and held in an upper open or contracted coring position shown in FIG. 1A and FIG. 2A by latch dogs 24. Latch dogs have beveled surfaces and are movable radially in slots in the enlarged spline portion 26 of inner core barrel assembly 12 into and out of upper and lower axially spaced internally beveled cylindrical grooves 30 in an engaging section 15 with female splines 29 in the outer barrel assembly 11.

A hollow latch dog actuating cylinder or piston 32 is slideably mounted within the enlarged spline section 26 and normally resiliently held in an upper portion by a spring 33 whereby the dogs 24 are forced outwardly by the engaging beveled full diameter position 34 of the actuation cylinder 32.

Figure 3:
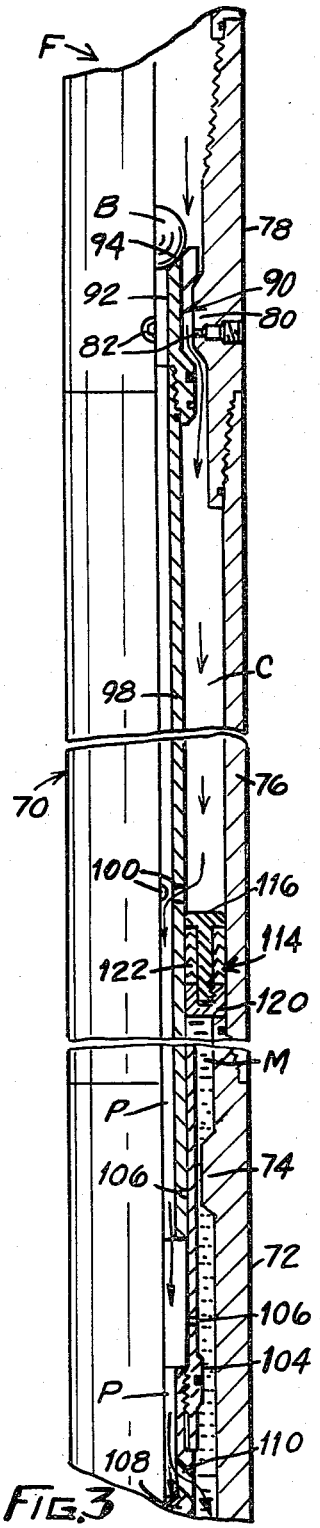
FIGS. 3 and 3A combined provide a partial cross sectional view showing the flushing apparatus and the flushed core barrel actuated thereby in a sealed mode.
Figure 3A:
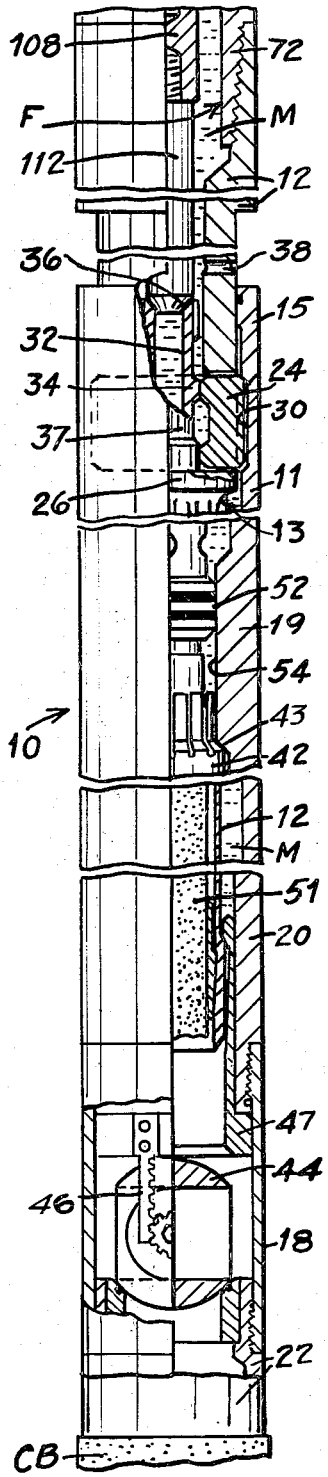

Actuation of the cylinder 32 moves portion 34 downwardly allowing dogs 24 to move inwardly and release outer barrel assembly for downward movement relative thereto to the core barrel closed and sealed position shown in FIG. 3A.

Movement of the outer barrel assembly 11 relative to the inner core barrel assembly 12 places the lower core barrel assembly 12 and core sample 51 therein above the ball valve 44, actuates a rack and pinion 46 to close the ball valve 44 and bring sealing surfaces 52 and 54 together to close and seal off upper and lower ends thereof and provide a sealed chamber about the core sample therein.

Also at the end of downwardly movement the dogs 24 are resiliently forced outwardly into the upper groove 30 and lock the inner and outer barrel assembly together for removal to the surface.

Means for flushing drilling fluid or mud from a core barrel situated downhole under existed downhole pressures and conditions is provided comprising a downhole flushing system, or device F adapted for connection to the core barrel assembly 10 and an adjacent portion of the drill string above it.

The downhole flushing device F shown in various modes in the drawings comprises an outer barrel assembly 70 including a lower seal section 72 connected to and extending upwardly from the upper end portion of the inner core barrel assembly 12 to an opposite end portion thereof having a lower seal portion 74 with an internal seal engaging surface therein. An intermediae section or cylinder 76 is connectd to and extends from the opposite end of lower seal section 72 to its opposite end connected to the lower end of an upper seal section 78. Upper seal section 78 has an upper seal portion 80 including upper and lower beveled annular surfaces or shoulders extending to an internal seal engaging surface thereof and aperture into which are threaded or fastened shear pins 82 and an opposite end connected to the adjoining section of the drill string.

Figure 1A:
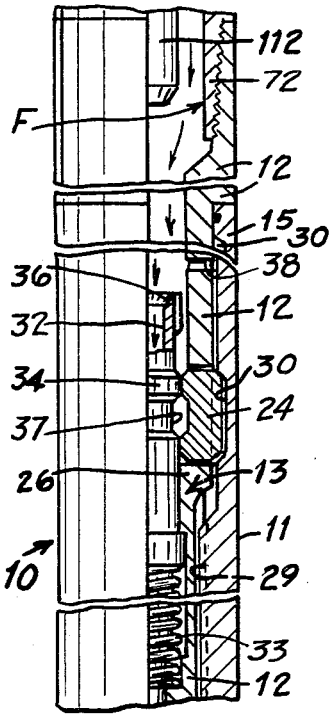

An inner barrel assembly 90 with an internal passage P is mounted within the outer barrel assembly and held in the initial upper most position and core drilling mode shown in FIGS. 1 and 1A by end portions of the shear pins 82. The inner barrel assembly 90 comprises an upper tubular seal section 92 including an upper end with an internal ball seat 94, a central passage and a lower seal portion 96. Seal portion 96 has an external surface, with a groove into which an annular seal or O-ring is situated for sealing engagement with the internal surface of seal portion 80 and shear pin receiving recesses or groove into which end portions of the shear pins 82 extend.

Sealingly attached to and extending from the lower or opposite end of the section 92 is an intermediate inner tube section or cylinder 98 having radial passages 100 extending from the internal passage P to an external surface spaced from the internal surface of the outer intermediate section or cylinder 76 of the outer barrel assembly 70 and an annular cylinder or chamber C therebetween.

A lower outer tube or section 102 including an internal surface thereof extends around a predetermined axial length of the lower exit end portion of the inner tube 98 to an upper end portion including an annular or O-ring seal sealingly engaging the external surface of the tube 98 above the passages 100.

The opposite lower internally threaded end or intermediate portion of the outer tube 102 has an external seal portion 104 including an external surface and a groove with an annular seal or O-ring therein for sealingly engaging the internal surface of the lower seal portion 74 in section 72 of the outer barrel assembly 70.

A second set of shear pins 106 attached to the outer tube 102 adjacent the portion 104 extend into recesses or a groove in the lower end portion of the inner tube 98 connected thereto and abutting an end of an exit end portion or coupling 108 attached to or threaded into the opposite lower end or intermediate portion of the outer tube 102. The coupling has central bore at an upper end communicating with the central passage and inclined radial passages 100 connecting the inner or internal central passage with an outer lower passage or chamber extending below the engaging seal portions 74 and 104 to connecting passages in the core barrel assembly 10.

The coupling 108 has an internally threaded lower end portion to which is attached a trip plug 112 including a tapered end portion adapted for sealing engagement with the ball seat 36 at the upper end of the core barrel actuating cylinder 32.

An annular free floating piston 114 is provided at the top or entrance of the sealed annular cylinder chamber for displacing an annular column of a suitable flushing medium M such as gelled kerosene or an equivalent material filling the entire portion and volume of the sealed annular cylinder chamber C bellow the piston 114.

Preferably the annular piston 114 has an upper annular head or end portion 116, a narrow central tubular or annular wall or extension 118 with a threaded lower end threaded into an adjustable lower annular head or packing nut 120 and inner and outer annular packing seals 122 situated in recessed opposite sides of the piston 114. Adjusting the packing nut or lower head 120 toward the packing seals 122 compresses and expands the packing seal rings for sliding and sealing engagement with the outer surface of inner tube 98 and inner surface of outer cylinder 76.

Figure 2:
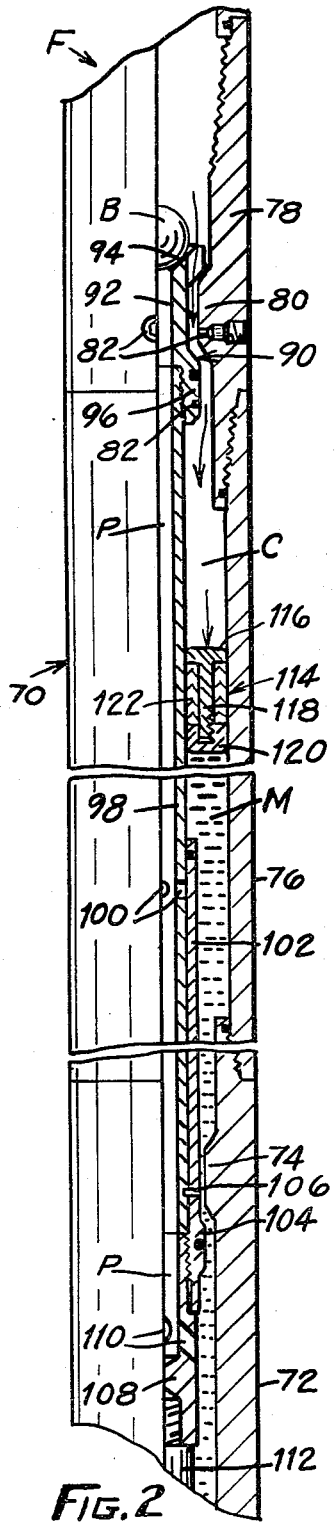
FIGS. 2 and 2A combined provide a partial cross sectional view showing the flushing device and the core barrel including a core sample therein in the flushing mode.
Figure 2A:
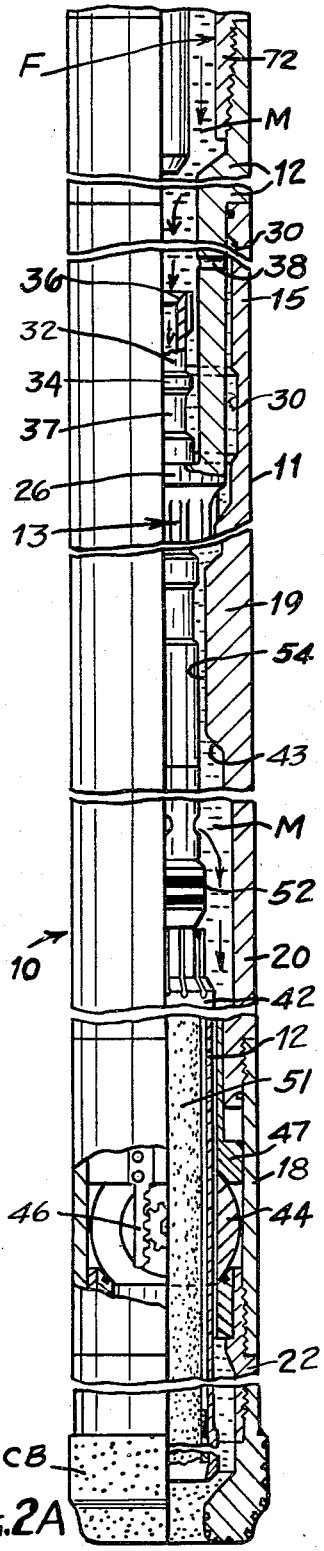

Once a core sample has been taken as shown in FIG. 2A the operation of the flushing apparatus or system F is initiated and sequentially shifted from the initial assembled core sample drilling and receiving mode shown in FIGS. 1 and 1A to the flushing mode shown in FIGS. 2 and 2A and to the core barrel actuating and sealing mode shown in FIGS. 3 and 3A by dropping or passing a ball B or other suitable plug means against the ball seat 94.

The ball B seating against the seat 94 stops flow of drilling fluid through the central passages causing the fluid pressure to increase and act against the upper exposed surface area above the seal portion 96 to displace the inner barrel assembly and shear off end of pins 82.

Shearing of pins 82 releases and allows the inner barrel assembly 90 to move downwardly relative to the annular piston 114, flushing medium M the outer and open core barrel assemblies and into the flushing mode shown in FIGS. 2 and 2A. Downward displacement of the inner barrel assembly is arrested by engagement of the enlarged slotted upper end portion thereof adjacent the ball seat 94 with the upper seal portion 80 of the outer barrel assembly section 78.

At this point the upper and lower seal portions 96 and 104 are disengaged from the portions 74 and 80 and provide an entrance passage for drilling fluid pressure to the head 116 of the annular piston 114 and an exit passage for the flushing medium displaced thereby to the open core barrel assembly.

Drilling fluid pressure acts against and forces the piston 114 downwardly in the annular chamber to displace the flushing medium M therefrom into the open core barrel assembly.

A large volume of flushing medium is forced into, fills and displaces the drilling fluid, mud and solids from all accessible passages in and between the components of inner core barrel assembly and the outer core barrel assembly prior to closure thereof.

Hence, the operation and reliability of the various components of the core barrel mechanisms are enhanced and less prone to fail.

Nearing the end of its travel the lower packing head 120 of the piston 114 engages the upper annular end surface of the outer tube 102 which is forced to shear off the ends of the shear pins 106.

The piston 114 continues to move downwardly and simultaneously displace the flushing medium, the tube 102, attached coupling 108 and trip plug 112 including its tapered end into sealing engagement with the valve seat 36 of the resiliently biased core barrel actuation cylinder 32 to close off the central passage therein as shown in FIG. 3A.

During this latter movement of the piston 114 to its arrested exit end position against the annular end surface of section 72 the passages 100 in inner tube or cylinder 98 are uncovered and allow drilling fluid under pressure to pass into the central passage and out the passages 110 in the coupling 108 to actuate the core barrel assembly 10.

The core barrel assembly 10 is actuated, closed and sealed with a core samples therein as shown in FIG. 3A by the pressure of the drilling fluid acting against the exposed surface area of the upper end of the actuation cylinder 32 around the trip plug 112 and the internal surface area of the coupling attached to the trip plug.

When sufficient pressure builds up to over come the resistance of the spring 33 the outer tube 102, attached coupling 108, trip plug and the cylinder 32 resiliently maintained in engagement therewith move downwardly as a unit relative to the inner tube 98, the enlarged spline portion 26 of the inner core barrel assembly 12 and the dogs 24 therein.

Downward displacement of the cylinder 32 and beveled portions 34 thereof out of engagement with the latch dogs 24 allows the weight of the outer core barrel and the engaging internal beveled surfaces of the lower cylindrical groove 30 in section 15 of the outer core barrel assembly 11 to bias the dogs inwardly into recess portions 37. The released outer core barrel assembly 11 discends both under its own weight or force of gravity and a differential hydraulic forced applied by the drilling fluid passing through apertures 38 to assure its descent and closure.

The outer barrel assembly 11 moves downwardly placing seal surface 54 of section 19 into engagement with seals 52, actuating rack and pinion 46 and closing ball valve 44 which together provides a sealed chamber therebetween with the core sample 51 sealed therein at conditions and pressures of formation existing downhole. When the outer core barrel assembly 11 is at its arrested lower position, the upper internal cylindrical groove 30 of section 15 thereof is aligned with the dogs 24 which are continuously biased outwardly by the engaging portions 34 of the cylinder 32 continuously biased upwardly by spring 33.

Hence, the cylinder 32, trip plug 112, coupling 108 and outer tube are likewise biased upwardly by spring 33 and maintain the inner and outer core barrel assemblies 11 and 12 locked together for travel to the surface.

At the surface the sealed core barrel assembly 10 is disconnected from the drill string and the flushing barrel assembly F for freezing, removal and analysis of the core sample therein.

As many embodiments of the invention are possible, it is to be understood that the embodiment disclosed here is by way of example only and that the invention includes all embodiments and equivalents thereof falling within the scope of the appended claims.

I claim:

1. A core barrel flushing device adapted for attachment to a drill string and a core barrel to be flushed under existing downhole core sample taking conditions and pressure comprising:

an outer barrel, an inner barrel within the outer barrel and having an internal passage for allowing drilling fluid to pass therethrough to the core barrel, a chamber of predetermined axial length and volume within the outer barrel and having an entrance end portion and an opposite exit end portion, a piston movable in the chamber, relative to the inner and outer barrels, a flushing medium of sufficient predetermined volume in the chamber between the piston and the exit end of the chamber, seal means at the entrance and exit end portions of the chamber adapted for sealing off the chamber, and actuating means for closing off the internal passage and flow of drilling fluid therethrough, providing an entrance passage for fluid under pressure to act upon and displace the piston, and an exit passage for the flushing medium displaced by the piston into and flush the core barrel downhole.

2. A core barrel flushing device according to claim 1 further comprising:

tripping means operable by movement of the piston near the end of its flushing stroke for actuating and sealing the flushed core barrel and core sample therein downhole.

3. A core barrel flushing device according to claim 1 further comprising:

releasable means for initially maintaining the inner barrel fixed relative to the outer barrel and releasable by the actuating means to allow displacement of the inner barrel relative to the outer barrel.

4. A core barrel flushing device according to claim 3 wherein the seal means comprises:

seal engaging surface portions of the inner and outer barrels adapted for initially sealing off the entrance and exit end portions of the chamber and disengagable by displacing the inner barrel relative to the outer barrel to provide the entrance passage for fluid under pressure to the piston and the exit passage for the flushing medium from the chamber to the core barrel.

5. A core barrel flushing device according to claim 4 wherein the inner barrel comprises:

an inner tube initially sealingly fixed to and displaceable a fixed amount relative to the outer barrel and slidably engaged by the piston in the adjoining chamber;

an outer tube slidable about an exit end portion of the inner tube, adapted to sealingly engaged the outer barrel initially fixed to and displaceable with the inner barrel relative to the outer barrel, and displaceable relative to the inner tube and outer barrel by movement of the piston to the exit end of the chamber; and tripping means on an exit end portion of the outer tube displaceable by the piston for actuating and sealing the flushed core barrel and core sample therein downhole.

6. A core barrel flushing device according to claim 5 wherein the inner tube comprises:

an internal passage for drilling fluid, an external seal engaging surface portion for initial sealing engagement with an internal seal engaging surface portion of the outer barrel, and disengagable by displacing the inner tube to provide an entrance passage to the chamber and piston therein, an external surface slidably engaged by the piston and extending a predetermined axial distance from the external seal engaging surface portion to an exit end surface thereof, and at least one aperture extending from the internal passage to the external surface of the inner tube wall and situated a predetermined axial distance from the exit end surface;

7. A core barrel flushing device according to claim 6 wherein the outer tube comprises:

an entrance end portion extending into an exit end portion of the chamber and about the inner tube to an end surface engagable and displaceable by the piston from an intial position beyond and closing off the aperture in the inner tube wall and having an internal surface adapted for sealing sliding engagement with the external surface of the inner tube and maintaining the aperture in the inner tube wall closed off during displacement of the flushing medium and until the piston has been displaced beyond the aperture to the exit end of the chamber whereby the aperture is exposed and allows fluid under pressure acting on the piston to exhaust into the inteernal passage further displacing the outer tube and attached tripping means;

an intermediate portion adjoining the entrance portion and having an external seal engaging surface portion for initial sealing engagement with an internal seal engaging surface portion of the outer barrel and disengagable by displacement of both the inner and outer tube to provide an exit passage for the flushing medium; and an exit end portion extending from the intermediate portion and having an end surface closing off one end of the internal passage, and at least one exit passage extending from the internal passage and through the outer tube wall for passing fluid under pressure to an outer passage extending between the exit end portion and the outer barrel to the core barrel.

8. A core barrel flushing device according to claim 7 further comprising:

second releasable means for initially maintaining the outer tube fixed to the inner tube prior to relative displacement thereof by the piston.

9. A core barrel flushing device according to claim 8 wherein the first mentioned and the second releasable means comprises:

first and second shear pins having portions connecting and preventing relative movement and adapted to be sheared off by the displacement of the inner tube relative to the outer barrel and the displacement of the outer tube relative to the inner tube respectively.

10. A core barrel flushing device according to claim 9 wherein the actuating means comprises:

seat means on the inner tube adapted for sealing engagement with plug means for plugging off the internal passage and flow of drilling fluid under pressure therethrough and applying the fluid under pressure to the plugged inner tube sufficient to displace the inner tube and shear the first of the shear pins.

11. A core barrel flushing device according to claim 10 wherein the tripping means comprises:

a trip plug adapted to sealingly engage a displaceable member of the core barrel actuating means, plug and prevent the passage of fluid under pressure through the core barrel and direct the fluid under pressure passing from the chamber above the piston through the aperture and into the internal passage to act against the closed end surface with the exit end portion of the outer tube and through the exit passage to the outer passage to act against the core barrel actuating means and thereby simultaneously displaces the inner tube and attached trip plug and the displaceable member of the core barrel actuating means to actuage, close and seal off the core barrel and core sample therein downhole.

12. A core barrel flushing device according to claim 11 wherein the piston and chamber have an annular configuration.

13. A core barrel flushing device according to claim 12 wherein the piston comprises:

an annular T-shape head having an axially extending annular central portion separating inner and outer annular recesses, an inner seal packing in the inner recess for sealing engagement with the external surface of inner tube, an outer seal packing in the outer annular recess for sealing engagement with an internal surface of the outer barrel, and an adjustable annular packing nut attached to the annular central portion for compacting and expanding the inner and outer annular seal packing into sealing engagement with the respective external and internal surfaces.

14. A method of flushing a core barrel downhole at existing conditions and pressures prior to retrieval to the surface comprising the steps of:

attaching a flushing device having a chamber containing flushing medium and means to displace the flushing medium therein to a core barrel for disposition downhole, positioning the flushing device and attached core barrel downhole to take a core sample, taking a core sample with the core barrel, and actuating the flushing device following disposition and the taking of a core sample downhole to displace the flushing medium from the chamber and into the core barrel.

15. A method of flushing a core barrel downhole according to claim 14 further comprising the step of:

providing the flushing device with means for actuating a core barrel adapted to seal a core sample therein following flushing thereof downhole.

* * * * *